United States Patent [19]

Hoss

[11] Patent Number: 4,685,571

[45] Date of Patent: Aug. 11, 1987

[54] SHIPPING UNIT

[75] Inventor: Donald A. Hoss, Southfield, Mich.

[73] Assignee: Chrysler Motors Corporation, Highland Park, Mich.

[21] Appl. No.: 926,275

[22] Filed: Nov. 3, 1986

[51] Int. Cl.[4] ..... B65D 81/02

[52] U.S. Cl. ..... 206/583; 206/557; 211/59.4

[58] Field of Search ..... 206/583, 521, 557; 211/59.4

[56] References Cited

U.S. PATENT DOCUMENTS

| | | | |
|---|---|---|---|
| 1,176,508 | 3/1916 | Williams | 211/59.4 |
| 2,982,419 | 5/1961 | Shiels | 211/59.4 |
| 3,388,792 | 6/1968 | Jones | 206/583 |
| 3,752,301 | 8/1973 | Bluemel | 206/583 |
| 4,267,684 | 5/1981 | Ambrose | 206/583 |
| 4,606,460 | 8/1986 | Luray | 206/583 |

*Primary Examiner*—Joseph Man-Fu Moy
*Attorney, Agent, or Firm*—Edward A. Craig

[57] ABSTRACT

A shipping unit is provided which protects easily damaged articles of manufacture during transit. The shipping unit includes a rack which comprises one or more of tiers of vertically spaced apart shelves which are fabricated of a pliable stretchable cloth. The vertical distance between each pair of vertically adjacent shelves in the unloaded condition is slightly greater than the thickness of the article of manufacture to be loaded thereon. Articles of manufacture are loaded thereon whereby the upper shelves stretch into contact with an article of manufacture loaded onto a lower shelf to steady the load on the rack and prevent damage to the articles of manufacture.

5 Claims, 4 Drawing Figures

SHIPPING UNIT

RELATED APPLICATION

This application is related to co-pending application Ser. No. 06/926,276, filed Nov. 3, 1986, entitled "Shipping Rack".

BACKGROUND OF THE INVENTION

1. Field of the Invention

This invention relates to a shipping unit having cloth shelves loaded with easily damaged articles of manufacture which prevents damage to the articles.

2. Prior Art

Shipping units of the type to which the present invention relates are intended to supplant shipping constructions used in the past for shipping articles of manufacture which are easily damaged. For example, in automotive manufacturing processes, some body panels are frequently manufactured into components at one location, either within an assembly plant or remotely located with respect to an assembly plant, and require shipment from the point of manufacture to the point of assembly. One example of such an article of manufacture is door trim panels. Door trim panels are manufactured as components which are ready for mounting on a car or truck. The surface areas are finished and ready for painting. Consequently, door trim panels must be safeguarded from being scratched, dented or otherwise damaged after they are manufactured and before they are mounted on a vehicle. If a door trim panel is damaged, it must be reworked entailing additional expense.

Previously, objects such as door trim panels have been transported by use of relatively expensive techniques. Cardboard has been used to individually box such items. Obviously, such individual boxing with subsequent opening of the box and disposal of the cardboard material is costly. Other techniques have involved the use of expensive shipping containers having buffered compartments, the buffers being made of rubber or like material which is relatively expensive and space-consuming resulting in higher shipping costs.

In accordance with the present invention, a shipping unit is provided which is easily loaded or unloaded and which uses relatively inexpensive cloth for shelving. The cloth is thin and therefore does not take up very much shipping space. The cloth is relatively inexpensive thus resulting in a low cost construction and low cost replacement of the shelves. This is all accomplished in a rack structure which is easy to move about either by means of a fork lift truck or by manual pushing.

SUMMARY OF THE INVENTION

A shipping unit is provided which protects easily damaged articles of manufacture during transit. The rack comprises a bottom wall having a width and length. An upstanding end wall is provided at each end of the length of the bottom wall. At least one tier of a plurality of vertically spaced apart shelves is suspended between the end walls. The shelves are accessible along the length of the rack for loading and unloading articles of manufacture transversely of the rack. The shelves are fabricated of a pliable stretchable cloth. The vertical distance between each pair of vertically adjacent shelves being slightly greater in the unloaded condition than the thickness of the article of manufacture to be loaded thereon, articles of manufacture loaded onto at least two adjacent shelves, the superjacent shelf being stretched by the article of manufacture which is loaded thereon into contact with an article of manufacture loaded onto the subjacent shelf.

A vertically extending panel is provided at each lengthwise end of the tier of shelves to prevent lengthwise movement of articles of manufacture which are loaded onto the shelves. A pair of transversely spaced apart vertical uprights are provided at each end of the length of the tier of shelves. A plurality of transversely extending vertically spaced apart rods are provided between each pair of transversely spaced apart vertical uprights. Each shelf is secured at each lengthwise end around a rod. A pair of rods to which each shelf is secured are located at substantially the same vertical level. Each rod is spaced closely adjacent to a panel face with portions of the shelf secured therearound being pressed between the rod and adjacent panel face to inhibit transverse movement of the shelf. A plurality of tiers of shelves may be provided along the length of the shipping rack. A plurality of transversely extending vertically spaced apart bars are secured between each pair of transversely spaced apart vertical uprights. The bars are positioned closely adjacent to the panel on the panel face opposite from the panel face closely adjacent to the rods to provide support in the lengthwise direction of the rack for the panels.

BRIEF DESCRIPTION OF A PREFERRED EMBODIMENT

Figure 1:
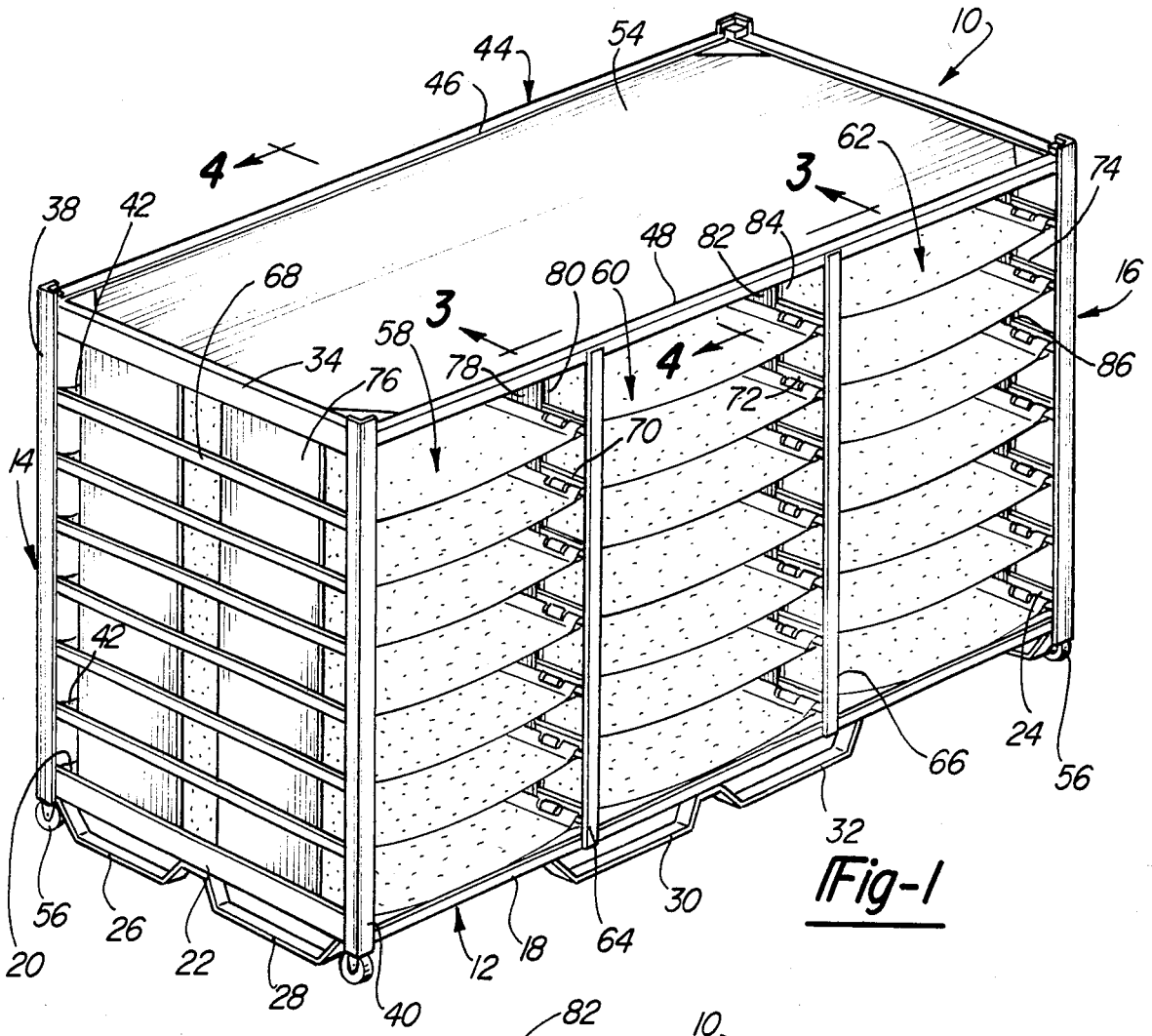
FIG. 1 is a perspective view of one embodiment of a shipping rack in accordance with the present invention.
Figure 2:
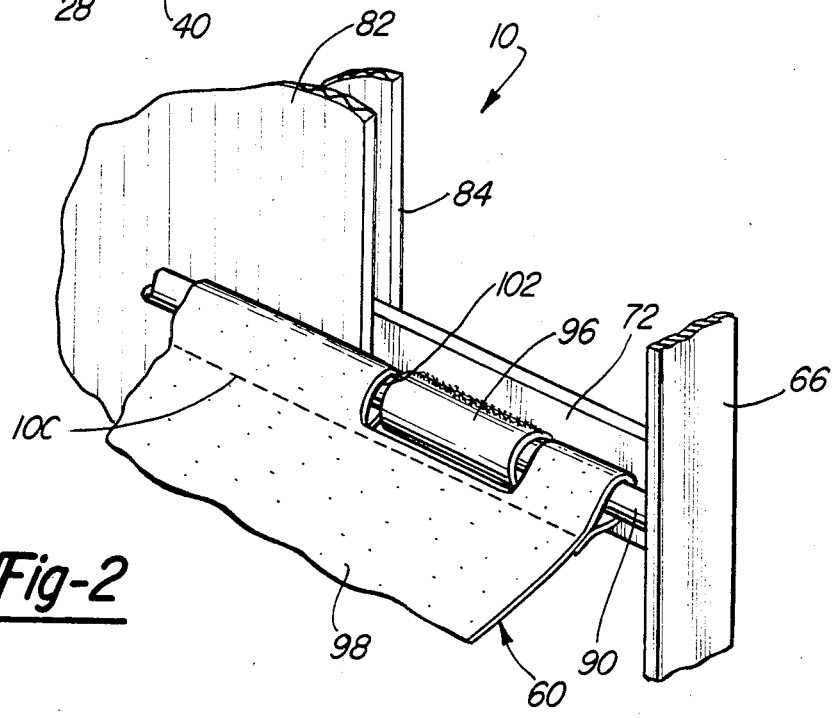
FIG. 2 is a perspective view of one end of a shelf and associated structure.

Referring to the drawing, it will be noted that the shipping rack 10 includes a bottom wall structure 12 having a width and a length with an upstanding end wall structure 14, 16 at each end of the length of the bottom wall. The bottom and end wall structures are made to be fabricated of welded steel angle members. Other materials may optionally be used for fabrication purposes as desired.

The bottom wall 12 comprises a frame consisting of side rail members 18, 20 and end rail members 22, 24. A pair of spaced apart loops 26, 28 are provided at each end of the bottom wall to facilitate manipulation of the rack by means of a fork lift truck. Similar loops 30, 32 are provided on each side of the bottom wall for use by a fork lift truck.

Each of the end walls comprises a frame consisting of an upper rail 34 and vertical end rails or uprights 38, 40 which are transversely spaced apart with respect to the width of the rack. As will be noted in FIG. 1, a plurality of vertically spaced apart longitudinally extending bars 42 are provided on the backside of the rack. These bars act to limit loading of articles onto the rack with respect to the width of the rack to prevent articles from being pushed out of the rack as they are being loaded.

A top wall structure 44 is also provided. The top wall structure 44 comprises side rail members 46, 48 which are connected to the end walls. A protective panel structure 54 is provided between these rails to prevent damage to the contents of the articles loaded onto the rack.

Casters 56 are provided at the lower end of the vertical uprights to permit manual pushing of the rack as desired.

Three tiers of shelves 58, 60, 62 are suspended between the end walls of the rack. More or fewer tiers may be used as desired. Additional pairs of vertical uprights 64, 66 which are transversely spaced apart are provided to accommodate the plurality of tiers of shelves. A plurality of transversely extending vertically spaced apart bars 68, 70, 72 74 are secured between each pair of transversely spaced apart vertical uprights. These bars are positioned closely adjacent to vertically extending pairs of panels 76, 78, 80, 82, 84, 86 on the panel face which is opposite from inhibit transverse movement of the shelf. It will be appreciated that the shelves, being fabricated of cloth material, could shift along the length of the rod which is undesirable as it would bunch the material of the shelves up and prevent proper seating of articles of manufacture loaded thereon. As previously mentioned, the bars 70, 72 are positioned closely adjacent to the panels on the panel face opposite from the panel face which is closely adjacent to the rods to provide support in the lengthwise direction of the rack for the panels. This prevents bulging of the panels in the lengthwise direction which would interfere or reduce the effective width of the shelves.

Figure 3:
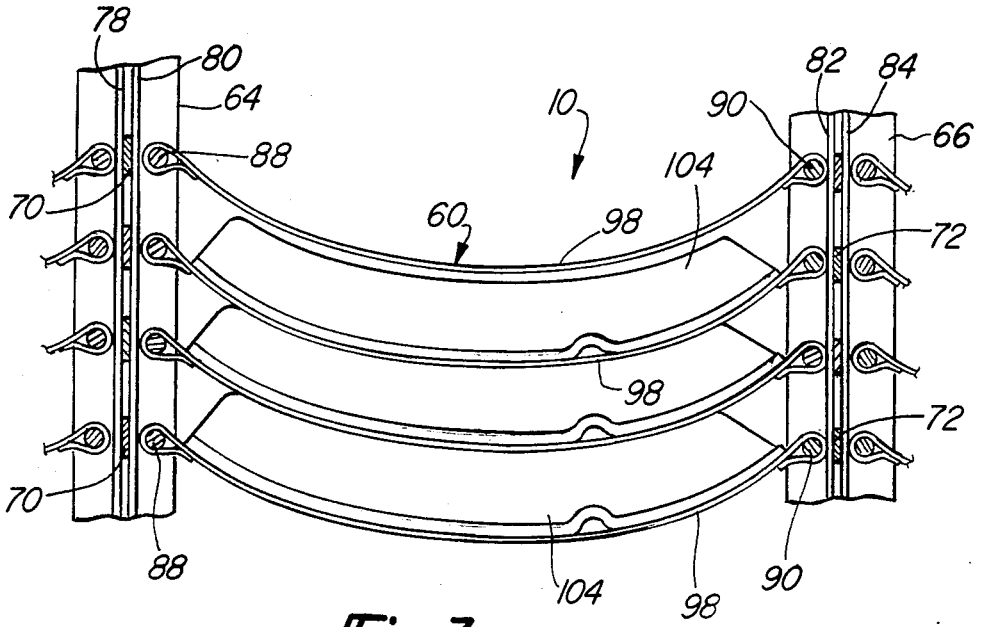
FIG. 3 is a sectional view taken substantially along the line 3—3 of FIG. 1 looking in the direction of the arrows, the section being a portion only of the tier of shelves, with articles of manufacture loaded onto the shelves.
Figure 4:
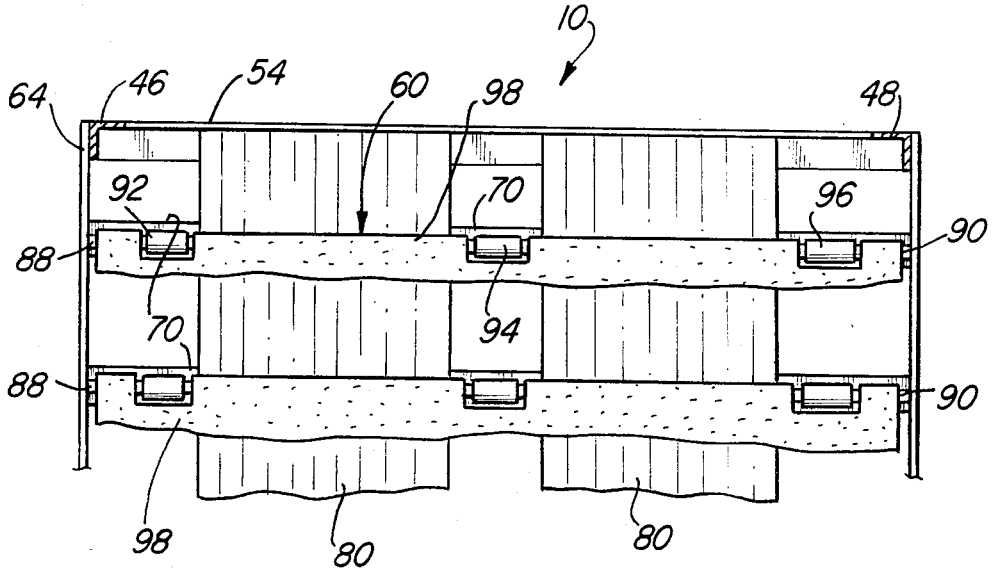
FIG. 4 is a sectional view taken substantially along the line 4—4 of FIG. 1 looking in the direction of the arrows, the section illustrating a portion only of the shelves.

With particular reference to FIG. 3, it will be noted that articles of manufacture, herein illustratively automotive door trim panels 104, are loaded onto the shelves 98. The shelves 98, which are attached to rods which are located at substantially the same vertical level, are spaced apart a vertical distance which is slightly greater than the thickness of the article of manufacture 104 which is loaded thereon. This results in the superjacent, or upper, shelves being stretched by the weight of the door trim panel. This stretching places the superjacent shelf into contact with the article of manufacture loaded onto the subjacent, or lower, shelf. The consequence of this is that the load on the rack 10 is steadied and the door trim panels are not damaged by contact with each other because of the interposition of the shelf material.

I claim:

1. A shipping unit which protects easily damaged articles of manufacture during transit comprising a rack including a bottom wall having a width and a length, an upstanding end wall at each end of the length of the bottom wall, at least one tier of a plurality of vertically spaced apart shelves suspended between the end walls, said shelves being accessible along the length of the rack for loading and unloading articles of manufacture transversely of the rack, said shelves being fabricated of a pliable stretchable cloth, the vertical distance between each pair of vertically adjacent shelves being slightly greater in the unloaded condition than the thickness of the article of manufacture to be loaded thereon, articles of manufacture loaded onto at least two vertically adjacent shelves, the superjacent shelve being stretched by the article of manufacture loaded thereon into contact with the article of manufacture loaded onto the subjacent shelve.

2. A shipping unit as defined in claim 1, further characterized in the provision of a vertically extending panel at each lengthwise end of the tier of shelves to prevent lengthwise movement of articles of manufacture which are loaded onto the shelves.

3. A shipping unit as defined in claim 2, further characterized in the provision of a pair of transversely spaced apart vertical uprights at each end of the length of the tier of shelves, a plurality of transversely extending vertically spaced apart rods between each pair of transversely spaced apart vertical uprights, each shelf being secured at each lengthwise end around a rod, the pair of rods to which each shelf is secured being located at substantially the same vertical level, each rod being spaced closely adjacent to a panel face with portions of the shelf secured therearound being pressed between the rod and adjacent panel face to inhibit transverse movement of the shelf.

4. A shipping unit as defined in claim 3, further characterized in the provision of a plurality of transversely extending vertically spaced apart bars secured between each pair of transversely spaced apart vertical uprights, the bars being positioned closely adjacent to the panels on the panel face opposite from the panel face closely adjacent to the rods to provide support in the lengthwise direction of the rack for the panels.

5. A shipping unit as defined in claim 1, further characterized in the provision of a plurality of tiers of shelves provided along the length of the shipping rack.

* * * * *